US006900406B2

(12) United States Patent
Huber

(10) Patent No.: US 6,900,406 B2
(45) Date of Patent: May 31, 2005

(54) OPERATING UNIT AND STOVE

(75) Inventor: Johann Huber, Inzell (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/945,294

(22) Filed: Sep. 20, 2004

(65) Prior Publication Data

US 2005/0034967 A1 Feb. 17, 2005

Related U.S. Application Data

(63) Continuation of application No. PCT/EP03/03282, filed on Mar. 28, 2003.

(30) Foreign Application Priority Data

Apr. 4, 2002 (DE) ..... 102 14 920

(51) Int. Cl.[7] ..... H01H 13/62
(52) U.S. Cl. ..... 200/566; 200/564; 200/336
(58) Field of Search ..... 200/4, 17 R, 520, 200/526, 529, 534, 564, 566, 318, 318.1, 321, 318.2, 322, 336, 341, 43.16, 43.18, 61.85, 61.86

(56) References Cited

U.S. PATENT DOCUMENTS 3,269,211 A * 8/1966 McGarry ..... 74/504
4,998,318 A * 3/1991 Nohtomi et al. ..... 16/441
5,384,442 A * 1/1995 Danner ..... 200/566
5,967,301 A * 10/1999 Reed et al. ..... 200/523
6,229,104 B1 * 5/2001 Matsui ..... 200/4
6,410,871 B1 * 6/2002 Rarbach ..... 200/336
6,720,513 B2 * 4/2004 Fleissner et al. ..... 200/336

FOREIGN PATENT DOCUMENTS

| | | |
|---|---|---|
| DE | 197 22 044 A1 | 12/1998 |
| EP | 0 709 513 A1 | 5/1996 |
| EP | 0 778 511 A1 | 6/1997 |
| JP | 2000315431 A | 11/2000 |

* cited by examiner

*Primary Examiner*—Michael A. Friedhofer
(74) *Attorney, Agent, or Firm*—John T. Winburn; Russell W. Warnock; Craig J. Loest

(57) ABSTRACT

A control unit, particularly for a cooking appliance, containing at least one depressible knob via which at least one switch can be actuated by an outward motion of the knob. The aim is to provide a control unit and cooking appliance of the aforementioned type, in which additional functions can be versatilely integrated in a structurally simple manner in a depressible knob without limiting the rotating motion of the knob. To this end, a blocking unit prevents the knob, in at least one rotating position, from being depressed and in this rotating position, the switch can be actuated by an outward motion of the knob that is transmitted to the switch via a transmitting unit.

11 Claims, 6 Drawing Sheets

OPERATING UNIT AND STOVE

CROSS-REFERENCE TO RELATED APPLICATION

This is a continuing application, under 35 U.S.C. § 120, of copending international application No. PCT/EP03/03282, filed Mar. 28, 2003, which designated the United States; this application also claims the priority, under 35 U.S.C. § 119, of German patent application No. 102 14 920.8, filed Apr. 4, 2002; the prior applications are herewith incorporated by reference in their entirety.

BACKGROUND OF THE INVENTION

Field of the Invention

The invention is based on a control unit, in particular for a stove top or burner unit, having at least one pop-out knob that can be used to operate at least one switch with a linear movement.

Operating units for a stove having a pop-out knob that is guided by a guide unit are known. The knob can be pushed-in in a neutral position and is prevented from being pushed-in in its remaining rotation positions by a blocking unit. Additional functions, such as activating a boost function or switching on a further zone, are implemented by turning the knob beyond a position associated with a maximum level. Turning the knob from the neutral position to the left, directly to the position associated with the maximum level, is precluded here due to the option of turning from the position associated with the maximum level to the right.

Published, Non-Prosecuted German Patent Application DE 197 22 044 A1 discloses an operating unit of this generic type for stoves which have a pop-out knob which can be used to operate a switch with a linear movement. The switch is operated when the knob is moved out of its pushed-in position and when the knob is moved to its pushed-in position. The switch controls an electrical circuit for a light fitting.

SUMMARY OF THE INVENTION

It is accordingly an object of the invention to provide an operating unit and a stove which overcome the above-mentioned disadvantages of the prior art devices of this general type, in which additional functions can be integrated in a pop-out knob in a flexible and physically simple manner.

With the foregoing and other objects in view there is provided, in accordance with the invention, a control unit. The control unit contains at least one switch, at least one pop-out knob for operating the at least one switch with a linear movement of the pop-out knob, a transmission unit, and a blocking unit. The knob is prevented from being pushed-in in at least one rotation position by the blocking, unit and, in a same rotation position, the switch can be operated by the linear movement of the knob, through the transmission unit.

The invention is based on the control unit, in particular for a stove, having at least one pop-out knob that can be used to operate at least one switch with a linear movement.

It is proposed to prevent the knob from being pushed-in in at least one rotation position by a blocking unit and in the same rotation position to allow the switch to be operated with the linear movement by the knob, via a transmission unit. The blocking unit can provide high operational reliability, and further functions can be integrated in the knob in a flexible and physically simple manner, and restriction to rotary movement of the knob, in particular restriction in terms of rotary movement from the neutral position directly to a position associated with a maximum level, can be easily avoided. Furthermore, the switch can advantageously be operated without the knob having to be returned to its rotation position associated with the pushed-in position, in particular its neutral position.

The switch may be formed by a variety of components which are considered to be useful by a person skilled in the art, for example by a light barrier which can be operated without contact or in particular by a linear movement switch, in which case the switch can be produced particularly cost-effectively and can also be used as a stop.

If a guide unit for the knob is disposed on a board, the switch may be disposed such that it is easily accessible with little complexity, specifically the switch may be disposed, in particular, directly on the board, as a result of which the use of additional wiring can be avoided.

Another refinement of the invention, proposes that the transmission unit be at least partially integral with the blocking unit. Advantageously, existing components can be used to operate the switch when the knob is not in a neutral position and savings can be made in terms of additional components, installation space, assembly effort and costs.

A physically simple and compact configuration can be achieved if the knob is configured so as to be rotatable with respect to a blocking element of the blocking unit, which blocking element is mounted such that it can move in the axial direction and on which an operating element for operating the switch is disposed, specifically in particular when the blocking element is in the form of a sleeve and has a base part which is in the form of an annular disk and can be used as a spring support for a spring which loads the blocking element and/or the knob.

The use of additional components can also be avoided by the operating element being integrally formed on the blocking element.

A further refinement of the invention proposes that the switch can be operated via the transmission unit in a rotation position in which the knob can be pushed-in. The knob can be assigned further functions, such as functions for controlling a display, a lighting unit etc., and savings can be made in terms of further operating elements and costs. In this case, two or more switches can be provided in total, or one switch may have different functions in different rotation positions of the knob.

If a switch for interrupting the electrical circuit is integrated in the operating unit, specifically in particular for an electrical circuit of a heating element, the use of an additional relay can be avoided, thus making it possible to save the costs associated with this. A live line and a neutral conductor of a heating element can be disconnected in a physically simple and cost-effective manner. In this case, for space reasons, the switch is advantageously in the form of a microcontact switch or of what is known as a 3 mm isolating switch.

Other features which are considered as characteristic for the invention are set forth in the appended claims.

Although the invention is illustrated and described herein as embodied in an operating unit and a stove, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
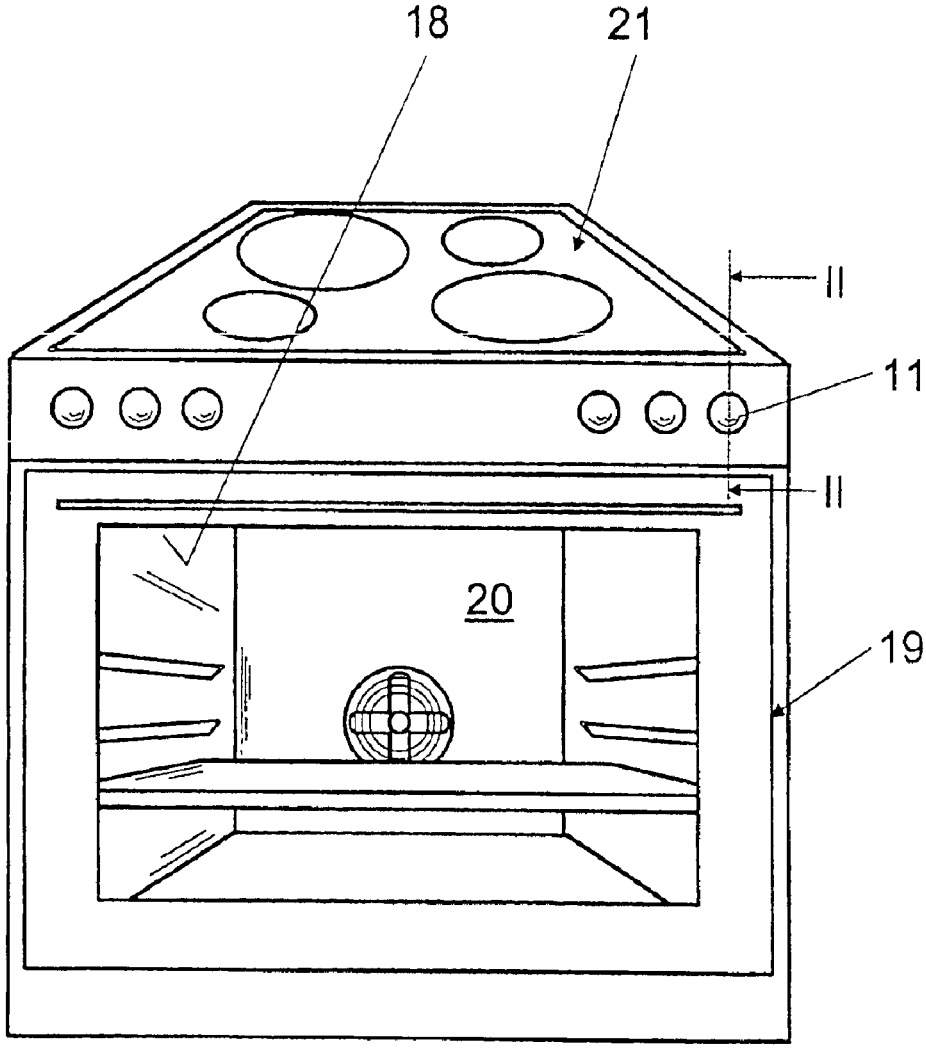
FIG. 1 is a diagrammatic, front perspective view of a stove according to the invention.

Referring now to the figures of the drawing in detail and first, particularly, to FIG. 1 thereof, there is shown a stove having an oven with a cooking area 20, which is bounded by a muffle 18 and an oven door 19, and having a cook top or hob 21 integrated on the top of the oven. The oven and the cook top 21 can be controlled by a control unit that has six pop-out knobs 11 on the front of the stove.

The configuration and operation of a knob 11 associated with the cook top 21 are described in more detail in the text which follows, the knob 11 associated with the cooking area 20 being of corresponding configuration.

Figure 2:
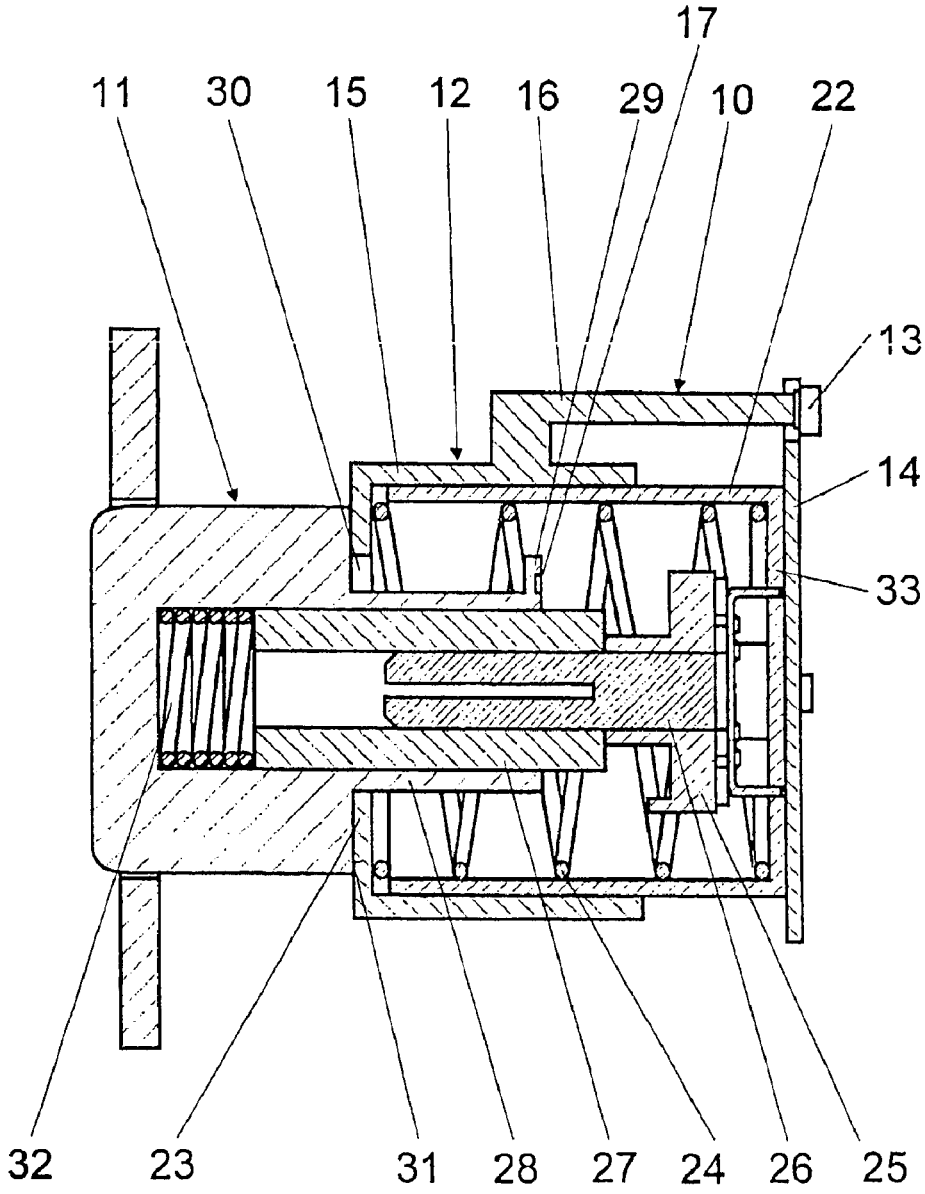
FIG. 2 is a diagrammatic, sectional view taken along line II—II shown in FIG. 1, through a knob with its guide unit in a neutral position and in a pushed-in state.

The knob 11 is guided by a guide unit 10 that is attached directly to a board 14 (FIG. 2). In addition to the guide unit 10, further electronic components that are considered to be useful by a person skilled in the art, such as evaluation modules, display elements etc., can be mounted on the board 14. The guide unit 10 has a first pot-shaped holder 22, whose base part 33 is permanently welded to the board 14. The holder 22 could also be attached to the board 14 by other connection methods considered to be suitable by a person skilled in the art, for example by riveting or clamping etc. A blocking element 15 of a blocking unit is guided on the holder 22 such that it can move in an axial direction, is in the form of a sleeve and has an annular base part 23 in the form of a disk.

An input unit having a bit generator 25 and a bit generator shaft 26, on which a knob shaft 27 is mounted, is disposed in the holder 22. Sliding contacts, magnetic input elements etc. could also be provided in place of the bit generator 25. Furthermore, a helical compression spring 24 is disposed in the holder 22, the first end of the helical compression spring 24 is supported on the base part 33 of the holder 22 and the second end of which helical compression spring 24 acts on the annular base part 23, which is in the form of a disk, of the blocking element 15. In the direction facing away from the bit generator 25, the blocking element 15 is secured on the holder 22 by a bayonet setting that is not shown in any more detail. The knob 11 has an integrally formed projection 28 (which is in the form of a sleeve and points in the direction of the bit generator) for mounting on the knob shaft 27 such that they rotate together and can move in the axial direction.

Figure 3:
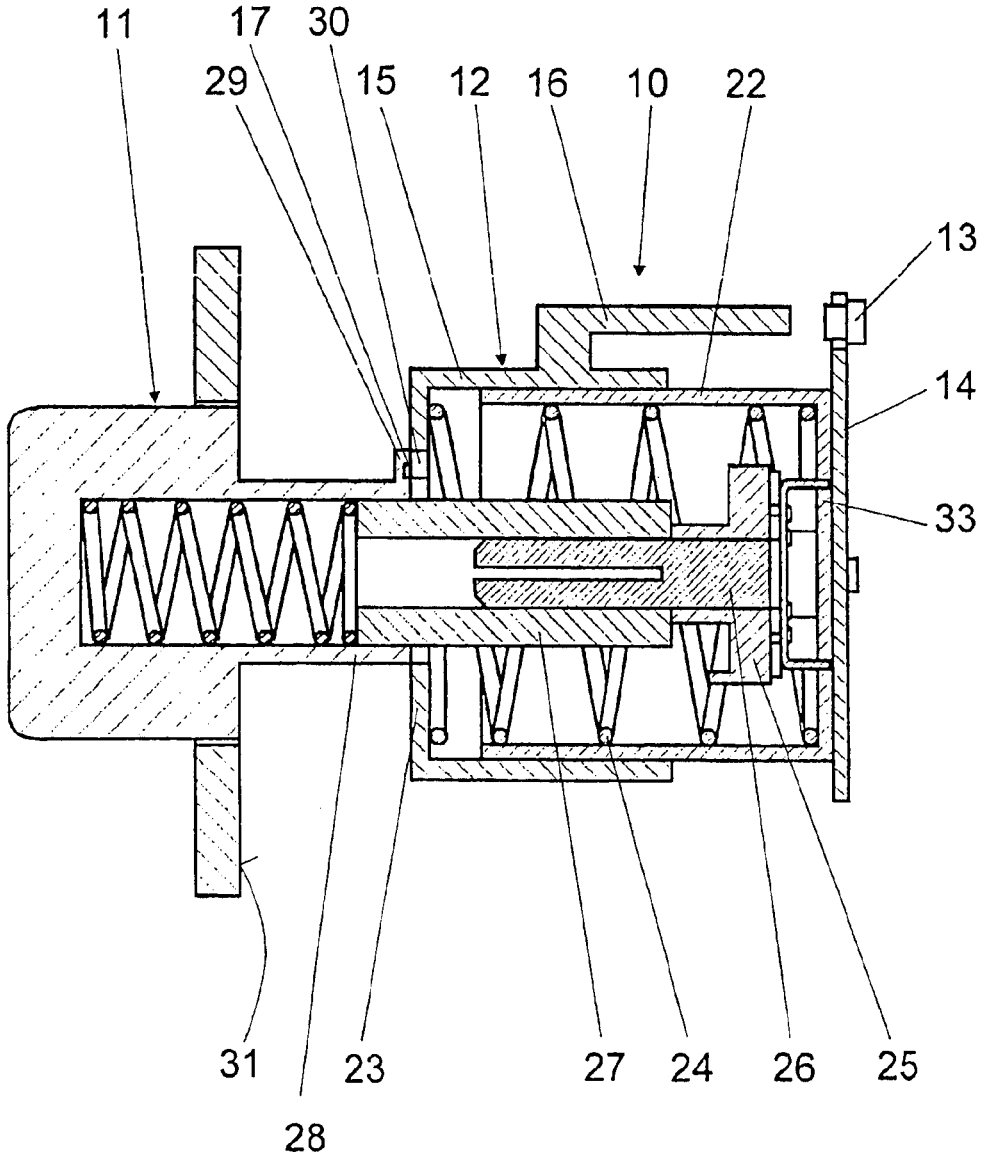
FIG. 3 is a diagrammatic, sectional view of the knob from FIG. 2 in an extended state.
Figure 5:
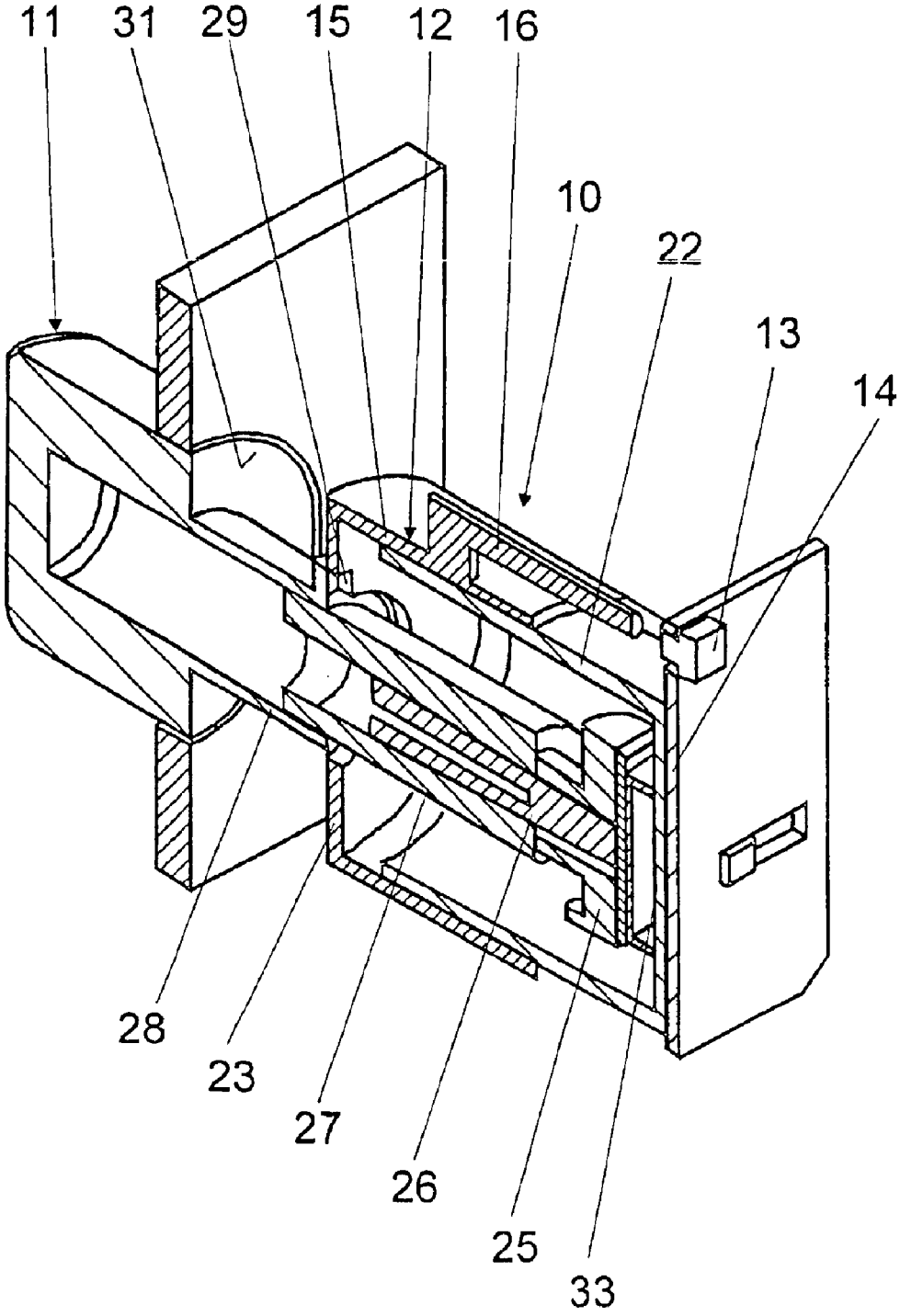
FIG. 5 is a perspective, sectional view of the knob with its guide unit.
Figure 6:
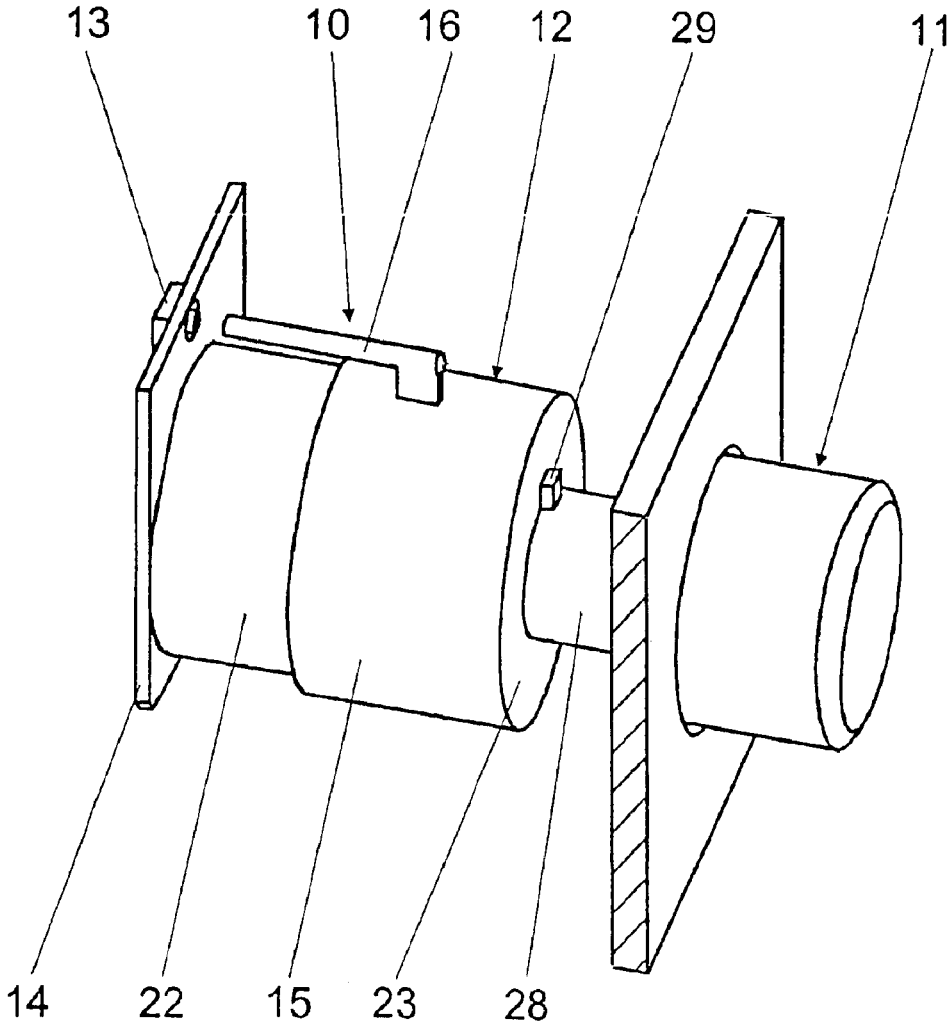
FIG. 6 is a perspective view of the knob and its guide unit.

In its pushed-in position, the knob 11 is loaded in the direction of its extended position by a helical compression spring 32, whose first end is supported on the knob shaft 27, and whose second end acts in the interior of the knob 11. The knob 11 is held in its pushed-in position by a latching unit, which is not shown in any more detail. When the latching unit is released and the knob 11 is moved out of its pushed-in position by the helical compression spring 32, a stop lug 29, which is integrally formed at the end of the sleeve-like projection 28 and extends radially outwards, moves through a corresponding recess 30 in the annular base part 23, which is in the form of a disk, of the blocking element 15 (FIGS. 3, 5 and 6). The knob 11 can then be turned away from its neutral position or away from its rotation position associated with the pushed-in position either to the left, directly to a position associated with a maximum or high cooking level, or to the right to a position associated with a low cooking level, the knob 11 being turned relative to the blocking element 15, which is mounted on the holder 22 such that they rotate together, and the bit generator shaft 26 in the bit generator 25 being turned with the knob 11 via the knob shaft 27. When the knob 11 is not in the neutral position, it is prevented from being pushed-in by the stop lug 29 and the blocking element 15 of the blocking unit.

Figure 4:
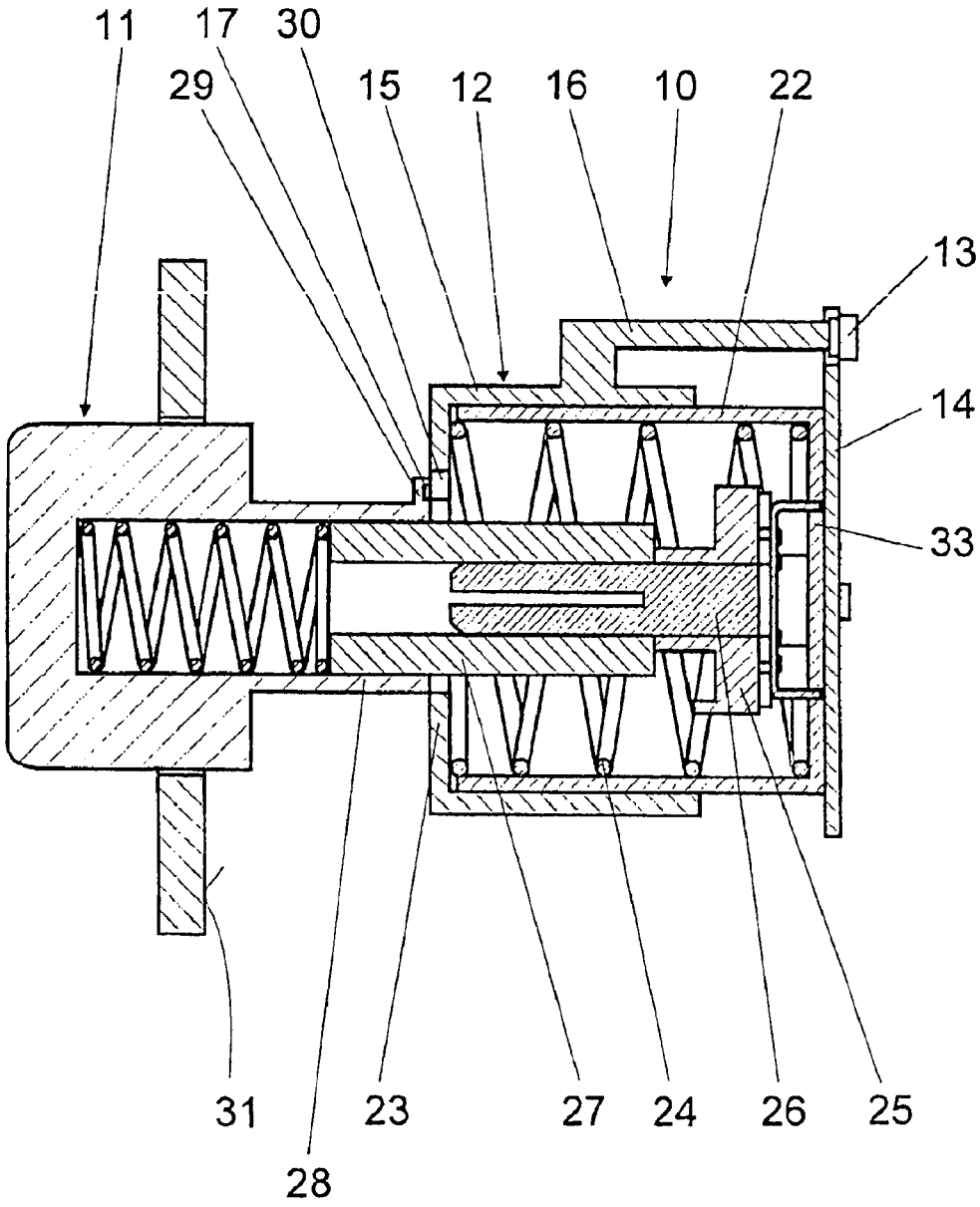
FIG. 4 is a diagrammatic, sectional view of the knob in a rotation position other than a neutral position, with a linear movement switch operated.

The stop lug 29 and the blocking element 15 form a transmission unit 12, by which a short-travel switch 13 fitted in a recess in the board 14 can be operated by a linear movement of the knob 11 when it is not in the neutral position. If the knob 11 is pressed inward when it is not in its neutral position, the stop lug 29 on the knob 11 acts on the base part 23, which is in the form of an annular disk, of the blocking element 15, thus causing the blocking element to be moved in the axial direction toward the board 14, against the spring force of the helical compression spring 24 (FIG. 4). In the process, an operating element 16, which is in the form of a plunger, is integrally formed on the outer circumference of the blocking element 15 and extends in the axial direction toward the board 14, comes into contact with the short-travel switch 13 and operates the latter. A boost function can be activated by the short-travel switch 13 when the knob 11 is not in the neutral position. It is also possible for further functions which are considered to be useful by a person skilled in the art to be controlled by the short-travel switch 13, for example, switching on a cooking zone, turning an oven light on and off or turning display illumination on and off etc. The linear movement of the knob 11 in order to operate the short-travel switch 13 advantageously covers approximately 2 to 5 mm.

If the knob 11 is rotated from a position associated with a cooking level to its neutral position, contacts of a microswitch 17 which are disposed on the stop lug 29 and on the annular base part 23, which is in the form of a disk, are disconnected and the power supply to a heating element associated with the knob 11 is interrupted. In the neutral position, the stop lug 29 on the knob 11 can be passed through the recess 30 in the annular base part 23, which is in the form of a disk, and moved to its pushed-in position. Operation of the short-travel switch 13 by the stop lug 29 is precluded, but operation of the short-travel switch 13 by a second contact face 31 on the knob 11 is possible.

Shortly before the knob 11 reaches its pushed-in position, its contact face 31, which adjoins the projection 28 in the direction of an operator, comes to bear against the base part 23, which is in the form of an annular disk, of the blocking element 15. If the knob 11 is moved further in the direction of its pushed-in position, the contact face 31 on the knob 11 acts on the base part 23, which is in the form of an annular disk, of the blocking element 15, thus causing the blocking element 15 to be moved in the axial direction with respect to the board 14 against the spring force of the helical compression spring 24. In the process, the operating element 16, which is in the form of a plunger, is integrally formed on the outer circumference of the blocking element 15 and extends in the axial direction with respect to the board 14, comes into contact with the short-travel switch 13 and operates the latter. In the neutral position, as detected by the input unit, a controller that is not shown in any more detail allocates to the short-travel switch 13 a function which differs from the rest of the rotation positions. When the knob 11 is pushed-in, the short-travel switch 13 deactivates the display lighting, and when the knob 11 is extended, the short-travel switch 13 activates the display lighting.

I claim:

1. A control unit, comprising:

at least one switch;

at least one pop-out knob for operating said at least one switch with a linear movement of said pop-out knob;

a transmission unit; and a blocking unit, said at least one knob prevented from being pushed-in in at least one rotation position by said blocking unit and, in a same rotation position, said at least one switch can be operated by the linear movement of said at least one knob, through said transmission unit.

2. The operating unit according to claim 1, further comprising:

a board; and a guide unit for guiding said knob and disposed on said board.

3. The operating unit according to claim 2, wherein said switch is disposed on said board.

4. The operating unit according to claim 1, wherein said transmission unit is at least partially integral with said blocking unit.

5. The operating unit according to claim 4, wherein said blocking unit has a blocking element, said at least one knob is configured to rotate with respect to said blocking element of said blocking unit, said blocking element is mounted such that the blocking element moves in an axial direction; and further comprising an operating element for operating said at least one switch, said operating element disposed on said blocking element.

6. The operating unit according to claim 5, wherein said blocking element is a sleeve and has a base part in a form of an annular disk.

7. The operating unit according to claim 5, wherein said operating element is integrally formed on said blocking element.

8. The operating unit according to claim 1, wherein said at least one switch can be operated through said transmission unit in a rotation position in which said at least one knob can be pushed-in.

9. The operating unit according to claim 1, further comprising a further switch integrated in order to interrupt an electrical circuit to a burner unit controlled by said at least one knob.

10. The operating unit according to claim 1, wherein the control unit is disposed in a stove.

11. A stove, comprising:

a control unit, containing:

at least one switch;

at least one pop-out knob for operating said at least one switch by a linear movement of said pop-out knob;

a transmission unit; and a blocking unit, said at least one knob prevented from being pushed-in in at least one rotation position by said blocking unit and, in a same rotation position, said switch can be operated by the linear movement of said knob, through said transmission unit.

* * * * *